United States Patent [19]

Gregory

[11] Patent Number: 4,914,926

[45] **Date of Patent: * Apr. 10, 1990**

[54] HOT GAS DEFROST SYSTEM FOR REFRIGERATION SYSTEMS AND APPARATUS THEREFOR

[76] Inventor: Charles Gregory, 1348 #5 Highway, Burlington, Ontario, Canada, L7R 3X4

[ * ] Notice: The portion of the term of this patent subsequent to Feb. 7, 2006 has been disclaimed.

[21] Appl. No.: 205,773

[22] Filed: Jun. 13, 1988

Related U.S. Application Data

[63] Continuation-in-part of Ser. No. 78,950, Jul. 29, 1987, Pat. No. 4,802,339.

[51] Int. Cl.[4] ..... F25B 47/00

[52] U.S. Cl. ..... 62/196.4; 62/278; 62/511; 62/513

[58] Field of Search ..... 62/513, 113, 511, 278, 62/81, 196.4, 503, DIG. 17

[56] References Cited

U.S. PATENT DOCUMENTS

| | | | |
|---|---|---|---|
| 2,526,379 | 10/1950 | Maseritz | 62/234 X |
| 2,693,678 | 11/1954 | Toothman | 62/234 X |
| 2,694,296 | 11/1954 | Prosek et al. | 62/278 |
| 2,729,950 | 1/1956 | Toothman | 62/277 X |
| 3,021,693 | 2/1962 | Aune | 62/278 |
| 3,138,007 | 6/1964 | Friedman et al. | 62/278 |
| 3,195,321 | 7/1965 | Decker et al. | 62/278 |
| 3,513,664 | 5/1970 | Duffney | 62/278 X |
| 4,184,342 | 1/1980 | Pohl | 62/511 |
| 4,238,932 | 12/1980 | Schrader | 62/513 X |
| 4,802,339 | 2/1989 | Gregory | 62/278 X |

*Primary Examiner*—Harry B. Tanner
*Attorney, Agent, or Firm*—Rogers & Scott

[57] ABSTRACT

This invention is associated with my prior invention of a full flow vaporizer for use in a refrigeration system employing hot gas from the compressor to periodically defrost the cooling coil, or coils where multiple coils are employed. The vaporizer usually consists of three concentric circular cross-section tubes. The inner tube receives the fluid from the coil and is provided in its wall with a plurality of fine bores directing the fluid forcefully radially outwards against the inner wall of the middle tube, which is heated by the hot gas. The flow capacities of the passages and the bores are chosen to be in a specific range of flow capacities relative to one another, so that when not in use the vaporizer has no appreciable effect on the remainder of the system. An orifice or restriction is provided at the outlet for the hot gas from the third annular passage and increases the back-pressure applied to the compressor, rendering the device self-balancing to prevent compressor motor overload. This invention provides a refrigerant vaporizer of different configuration, namely three rectangular chambers having two walls in common. In some apparatus each restrictor is provided downstream with a respective expansion chamber to re-evaporate any liquid that passes through the restrictor and maintain gas flow velocity. In a multiple evaporator system each evaporator is provided with a respective adjustable restrictor to permit equalization of the pressure drops in the individual hot gas lines and consequent equalization of the respective defrost requirements.

116 Claims, 4 Drawing Sheets

HOT GAS DEFROST SYSTEM FOR REFRIGERATION SYSTEMS AND APPARATUS THEREFOR

CROSS REFERENCE TO RELATED APPLICATION

This application is a continuation-in-part of my prior application Ser. No. 07/078,950, filed July 29, 1987 (U.S. Pat. No. 4,802,339).

FIELD OF THE INVENTION

This invention is concerned with improvements in or relating to refrigeration systems, and especially to hot gas defrost systems for refrigeration systems and to apparatus for use in such hot gas defrost systems.

REVIEW OF THE PRIOR ART

The cooling coil of any refrigeration system will gradually collect frost or ice on its surface, due to the fact that water vapour in the air in contact with the coil condenses on it, and its temperature is usually low enough for the moisture to freeze on it. Ice is a relatively good heat insulator and if allowed to build up will initially lower the efficiency of the refrigerator, and eventually cause it to become ineffective. The situation is more extreme in large commercial installations in which the ambient air is force circulated over the cooling coil or coils by a fan, because of the larger volumes of air which contact the coil.

It is standard practice therefore in all but the simplest refrigerator or refrigerator installation to provide a system for automatically defrosting the coil, usually by arranging that at controlled intervals it is warmed to a temperature and for a period that will melt the ice, the resultant water being drained away. There are two principal methods currently in use for automatic defrost, namely electrical and hot gas.

In an electrical defrost system electric heating elements are provided in contact with the coil; at the required intervals the refrigeration system is stopped from operating and the elements are switched on to provide the necessary heat. In a hot gas defrost system the hot gas delivered from the compressor, that normally goes to an exterior coil to be cooled, is instead diverted into the cooling coil, again for a predetermined period found from experience to be satisfactory for the purpose. Both systems have their advantages and disadvantages.

An electrical system is relatively easy to design and install, but is more costly to implement and much less energy efficient than a hot gas system A. hot gas system is less costly to install but has been difficult to design; a particular problem of such systems is that the compressor, the most expensive single component of the system, is easily damaged if it receives liquid refrigerant instead of gaseous refrigerant at its inlet. The heat exchange between the hot gas and the cold ice-laden coil will tend to liquefy the refrigerant, and the resultant droplets are difficult to remove from the gas, with consequent danger to the compressor. A hot gas system delivers the heat directly to the tube of the coil and can therefore perform a comparable defrost with less energy expenditure than an equivalent electrical system. Moreover, the hot gas system effectively obtains its power from the compressor motor and requires only the addition of suitable flow valves and piping for its implementation; it is therefore the preferred system provided one is able to ensure that the expensive compressor is not damaged by the entry of liquid refrigerant.

Another problem with hot gas systems is the difficulty that the defrosting cools the circulating vapour to produce some liquid, reducing the quantity available to the compressor to keep it operating efficiently. In commercial installations the usual solution is to employ multiple evaporator coils and to defrost them one at a time, so that the other coils can maintain the vapour supply at a suitable level. This requires somewhat complex valving to achieve.

It is conventional practice to employ at least three separate coils, since it is considered that there is too much danger with only two coils of "running out of heat", so that the compressor does not receive sufficient vapour to operate. Some commercial installations use even more than three coils to ensure that this type of failure cannot happen, but this increases the overall complexity of the system and also increases the number of defrost periods required, so that it becomes difficult to schedule the defrost outside the peak shopping periods. There is a tendency in commercial supermarket practice to revert to small multiple installations in place of large central units, and these become expensive if multiple coils are required for defrost purposes, while electrical defrost is relatively expensive in operation for commercial purposes, although acceptable for domestic refrigerators for want of a more efficient system. There has been reluctance to apply hot gas defrost to a single coil refrigerator because of the difficulty of avoiding running out of vapour, or the alternative difficulty if the fluid from the evaporator coil is heated, for example by a heat exchanger, of ensuring that the compressor does not become overheated because of the too hot gas fed to its inlet.

One special group of systems in which defrost is a particular problem are those used on smaller transport trucks, since they must be able to operate alternatively from the truck engine while it is travelling, and from an electric plug-in point while stationary in the garage with the engine stopped. A hot gas defrost would be most satisfactory, but requires a complex reverse cycle and the majority of systems opt for an electric defrost while plugged in, the icing that occurs during running being accepted as unavoidable.

As an example of the energy required to operate an electrical defrost system in a commercial "cold room" intended for the storage of frozen meat at about −23° C. (−10° F.), a system employing a motor of 5 horsepower requires electric heating elements totalling 6,000 watts to satisfactorily defrost the coil, employing a heating cycle of four periods per day, each of 45 minutes duration. The daily consumption of defrost energy is therefore 18 kWH. This heat is injected into the room and must subsequently be removed by the system, adding to the cost of operation. The transfer of heat from the electric elements to the coil is not very efficient and in many systems it is found that during the defrost period the temperature in the cooled space rises from the nominal value to as high as 0° C. (32° F.), and this is high enough to cause thermal shock to some products, such as ice cream. Moreover, unsophisticated users of the system may be disturbed to find during a defrost period that the "cold" room is unexpectedly warm and conclude that the system is faulty, leading to an unnecessary service call.

Another type of apparatus incorporating a refrigeration system is a heat pump, as used for space heating and cooling in domestic housing and commercial establishments. It is usual practice with such systems for the outdoor coil to be air-cooled, owing to the expense of a ground-cooled system, and periodic defrosting of the outdoor coil is necessary when the system is in heating mode, because of the tendency of the coil to become ice-laden, especially when the outside temperature is low and the system is working at full capacity. "Reverse cycle" defrosting is by far the most common method of defrost employed, and in this method the unit is switched to the cooling mode and defrost occurs as hot gas from the compressor condenses in the outdoor coil. During defrost, the outdoor fan is usually de-energized because it would work against the defrosting process. This method requires the use of auxiliary resistance heaters because during defrost the unit is trying to cool the space, and the auxiliary heaters must be activated to temper the cool supply air. Thus, it is a common complaint with such systems that it is blowing cold air, and periodically the rooms that should be heated are instead cooled to the point of some discomfort. Ideally the number of defrost cycles should be held to a minimum because the compressor is subjected to wear and strain every time defrost is initiated, and experience has shown that damage occurs to the compressor due to sudden pressure changes as the cycle is reversed and liquid refrigerant enters the compressor. These systems are of course required to be as inexpensive as possible, so that single coils are used, and the difficulty described above of applying hot gas defrost to single coils has hitherto prevented its adoption, although a safe rapid hot gas defrost system would be of particular advantage with such systems.

DEFINITION OF THE INVENTION

It is therefore an object of the present invention to provide a new liquid refrigerant vaporizer for use in a hot gas defrost system of a refrigeration system.

It is also an object to provide a new hot gas defrost system for use in refrigeration systems.

In accordance with the present invention there is provided a liquid refrigerant vaporizer for use in a refrigeration system employing hot refrigerant fluid to defrost a coil or coils thereof, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected ar its other end into the refrigeration system for delivery of the refrigerant fluid therefrom;

wherein the cross-sectional flow area of the said second flow passage is at least 0.5 times the cross-sectional flow area of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith; and a refrigerant fluid flow restriction at or connected to the third flow passage outlet for producing an increase in back pressure of the refrigerant fluid in the second flow passage.

The invention also provides a hot gas defrost system and a refrigeration system employing such a refrigerant vaporizer.

The said first, second and third flow passages may be of rectangular configuration in plan and side elevation, when the said first and second common walls between the respective chambers are flat.

The liquid refrigerant vaporizer described and claimed in my prior U.S. Pat. No. 4,802,339 is also for use in a refrigeration system employing hot refrigerant fluid to defrost a coil or coils thereof, the vaporizer comprising first inner, second middle and third outer pipes mounted one within the other to provide a first innermost flow passage in the first inner pipe, a second annular flow passage between the first inner and second middle pipes, and a third annular flow passage between the second middle and third outer pipes.

Also in accordance with the present invention from another aspect the said refrigerant vaporizor is provided with an expansion chamber downstream of the restrictor for re-evaporation of any liquid component passing through the restrictor.

In accordance with the present invention from a further aspect, in a multiple evaporator refrigeration system, each evaporator is provided with a respective adjustable flow restrictor enabling adjustment of the pressure drop in the respective hot gas line and equalization of the pressure drops in the respective lines.

DESCRIPTION OF THE DRAWINGS

Embodiments of the invention will now be described, by way of example, with reference to the accompanying schematic and diagrammatic drawings, wherein.

DESCRIPTION OF THE PREFERRED EMBODIMENTS

Figure 1:
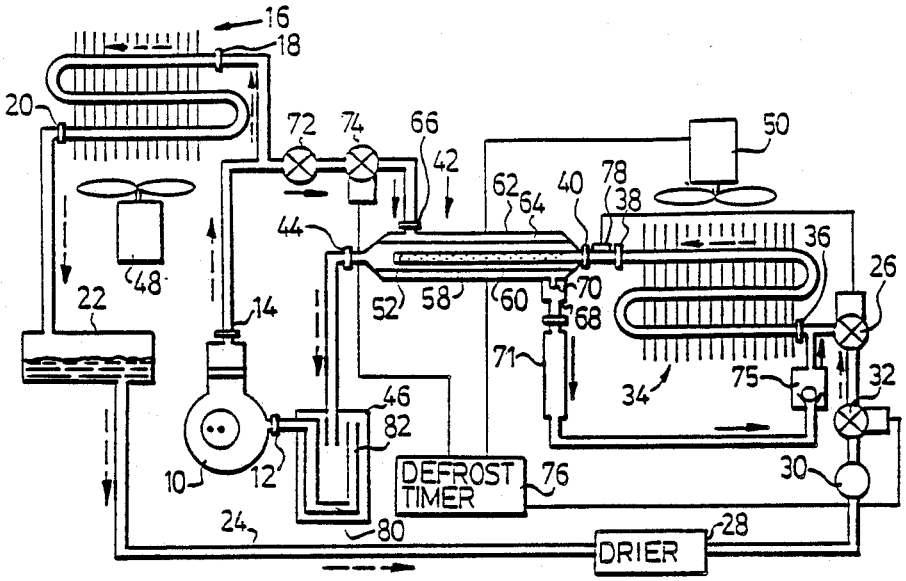
FIG. 1 is a schematic diagram of a refrigeration system embodying the invention.

FIG. 1 shows a refrigeration system which includes a compressor 10 having a suction inlet 12 and a high pressure outlet 14. A refrigerant condenser coil 16 has an inlet 18 connected to the high pressure outlet 14, and an outlet 20 connected to a vessel 22 which is adapted to collect liquid refrigerant. A refrigerant-conducting line 24 connects the vessel 22 to a thermostatic expansion valve 26 through a filter drier 28, a liquid indicator 30 and a solenoid-controlled liquid valve 32. The cooling coil 34 of the system has an inlet 36 connected to the expansion valve 26, and an outlet 38 connected to a refrigerant inlet 40 of a full flow liquid refrigerant vaporizer of the invention indicated generally by 42. The vaporizer 42 has an outlet 44 connected to the inlet of a suction line liquid accumulator 46, while the outlet of the accumulator 46 is connected to the suction inlet 12 of the compressor 10.

In its usual mode of operation hot compressed gas from the compressor is condensed in coil 16, a fan 48 being provided to circulate air over and through the finned heat exchange structure of the coil. With the valves 26 and 32 open liquid refrigerant expands in the expansion valve 26 and passes into the coil 34 to cool the coil and therefore the adjacent space, air being circulated over the coil by a fan 50. All the expanded refrigerant vapour passes through the vaporizer 42, whose structure and function will be described in detail below, to return to the compressor 10 via the accumulator 46. This is of course a standard mode of operation for a refrigeration system, and this particular flow is illustrated by the broken line arrows.

Figure 2:
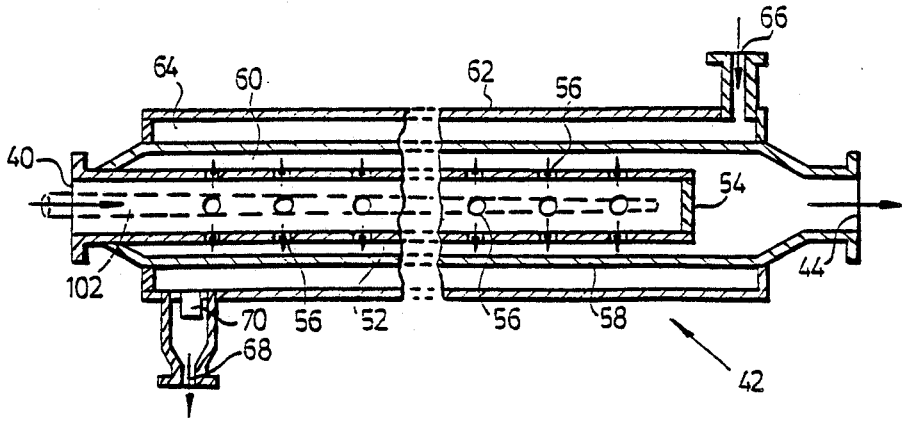
FIG. 2 is a longitudinal cross-section through a concentric tubular full flow liquid refrigerant vaporizer which is a first embodiment of the invention.

The construction of the concentric tubular liquid refrigerant vaporizer of FIG. 1–4 will now be described with particular reference to FIG. 2. The vaporizer 42 includes a first inner pipe 52 providing a corresponding first inner bore, which is capped at one end by a cap 54, the other end constituting the refrigerant inlet 40. The pipe 52 has a plurality of holes 56 distributed uniformly along it and around its circumference.

A second intermediate or middle pipe 58 of larger cross-section than the pipe 52 surrounds it, so as to be coaxial with it and to form between itself and the pipe 52 a second middle chamber 60 of annular cross-section which surrounds the pipe 52. The end of the pipe 58 adjacent to inlet 40 is sealed to the pipe 52 so that all of the holes 56 are within the pipe 58, while the other end projects beyond the capped end 54 of the conduit 52 and constitutes the refrigerant outlet 44. The pipe 58 is made of a suitable heat-conductive material, for example copper, brass or the like.

A third outermost conduit 62 encloses at least that portion of the pipe 58 adjacent the location of the holes 56 in the inner conduit 52, and is sealed to the pipe 58 so as to define a third outer annular cross-section chamber 64 surrounding the pipe 58. A hot gas inlet 66 is provided at one end of pipe 62 and an outlet 68 at the other end, so that refrigerant fluid can be passed through the chamber 64 in contact with the outer wall of the heat-conductive pipe 58 and counter-current to the flow of refrigerant in the pipe 58.

The outlet 68 of the vaporizer is provided downstream with an orifice or restriction 70 of predetermined smaller size and an expansion chamber 71 whose functions will be explained in detail below.

The dimensions of the three pipes 52, 58 and 62 and of the apertures 56 relative to one another are important for the successful functioning of the vaporizer in accordance with the invention. Thus, the pipe 52 preferably is of at least the same internal diameter as the remainder of the suction line to the compressor, so that it is of the same flow cross-sectional area and capacity. The number and size of the holes 56 are chosen so that the flow cross-section area provided by all the holes together is not less than about 0.5 of the cross-section area of the pipe 52 and preferably is about equal or slightly larger than that area. The total cross-section area of the holes need not be greater than about 1.5 times the pipe cross-section area and increasing the ratio beyond this value has no corresponding increased beneficial effect. Moreover, each individual hole should not be too large and if a larger flow area is needed it is preferred to provide this by increasing the number of holes. A specific example will be given below. The purpose of these holes is to direct the flow of refrigerant fluid radially outwards into contact with the inner wall of the pipe 58, and this purpose may not be fully achieved if the holes are too large. The holes are uniformly distributed along and around the pipe 52 to maximize the area of the wall of pipe 58 that is contacted by the fluid issuing from the holes 56.

It is also important that the flow cross-section area of the second annular chamber 60 be not less than about 0.5 of the corresponding flow area of the pipe 52, and again preferably they are about equal with the possibility of that of chamber 60 being greater than that of pipe 52, but not too much greater, the preferred maximum again being about 1.5 times. The diameter of the pipe 62 is made sufficiently greater than that of the pipe 58 that the cross-sectional flow area of the annular space 64 is not less than that of the hot gas discharge line from the pump outlet 14 to the inlet 66, and can be somewhat larger, to the same extent of about 1.5 times. The inlet 66 to the chamber 64 and the outlet 68 are of course of sufficient size not to throttle the flow of fluid therethrough, and when the restriction 70 is a separate unit this will also be true of the outlet 68.

It will be understood by those skilled in the art that if the vaporizer is constructed in this manner then during normal cooling operation of the system it will appear to the remainder of the system as nothing more than another piece of the suction line, or at most a minor constriction or expansion of insufficient change in flow capacity to change the characteristics of the system significantly. The system can therefore be designed without regard to this particular flow characteristic of the vaporizer. Moreover, it will be seen that it can be incorporated by retrofitting into the piping of an existing refrigeration system without causing any unacceptable change in the flow characteristics of the syste. It will also be noted that it will allow refrigerant to flow equally well in either direction.

A hot gas defrost system of the invention comprises the full flow vaporizer 42, its inlet 66 being connected to the hot gas outlet 14 of the compressor via a control valve 72 and a hot gas solenoid-operated valve 74, while its outlet 68 is connected via a check valve 75 to the junction of coil inlet 36 and expansion valve 26. The operation of the defrost system is under the control of a defrost timer 76 connected to the fan 50 and the valves 32 and 74. The operation of the expansion valve 26 is under the control of a thermostatic sensor 78. The remainder of the controls that are required for operation of the system will be apparent to those skilled in the art and do not require description herein for understanding of the present invention.

At predetermined intervals the defrost timer 76 initiates a defrost cycle by closing the solenoid valve 32 so that expanded cold refrigerant is no longer supplied to the coil 34; the timer deenergizes the fan 50 and opens hot gas solenoid valve 74, whereupon heated high pressure vapour from the compressor flows through the outer annular chamber 64 of the vaporizer and heats the conductive pipe 58. The fluid exits at outlet 68 trough the restriction 70 and the expansion chamber 71 and passes through the check valve 75 to enter the coil 34. The fluid gives up sensible and latent heat to the coil, warming it and melting any frost and ice accumulation, the gas becoming cooler by the consequent heat exchange. The fluid moves through the coil at relatively high velocity and only part of it condenses to liquid.

The high velocity fluid with its entrained liquid enters the pipe 52 of the vaporizer and, because of the dead end provided by the cap 54 and the abrupt change of direction imposed upon it, becomes severely turbulent, far more so than the low velocity gas involved in the normal refrigeration cycle as described above. The resulting turbulent mist is discharged forcefully through the holes 56 into intimate contact with the whole length of the hot inner wall of the pipe 58, resulting in complete and substantially immediate evaporation of the fine droplets. Although the device is illustrated in horizontal attitude it will be apparent that its operation is independent of attitude and it can be disposed in any convenient location, unlike the accumulator which must be disposed as shown. The fluid in the chamber 60, consisting now entirely of vapour, exits through outlet 44 and the accumulator 46 to the compressor inlet 12. It may be noted that the accumulator 46 is not required for the hot gas defrost cycle and its sole purpose is to try to protect the compressor in case of a liquid refrigerant flow control malfunction. As is usual, any lubricant in the system that collects in the accumulator bleeds back into the circuit through bleed hole 80 in return pipe 82. At the end of the timed defrost period the timer 76 deenergizes and closes the hot gas valve 74, opens valve 32 and reenergizes the fan motor 50, so that the system is again in irs normal cooling mode.

The orifice or flow restrictor 70 is surprisingly effective in providing consistent defrosting and self-regulation of the process, the latter avoiding compressor overload and consequent stress. The orifice can of course be a controllable valve and may be separate from the vaporizer when retrofitted into a system to provide for suitable adjustment, while for a predesigned and prebuilt system it will usually be a fixed orifice.

One effect of the restriction is that the discharge pressure of the compressor is increased, resulting in a higher temperature and greater density of the fluid fed to the chamber 64, and consequently resulting in a fluid of higher energy content that ensures adequate heating of the wall of the pipe despite the speed at which the gas flows through the vaporizer.

Another effect is to produce a predetermined pressure drop in the saturated hot, high pressure refrigerant fluid flowing through it. This pressure drop causes the liquid in the fluid to vaporize using up part of its sensible heat, at the same time increasing its volume and therefore its velocity through the check valve 75 and into the coil 34. I will be noted that the velocity of the hot gas is nor diminished by the vaporizer 42 because of its full flow characteristic backed by the full suction that can be maintained by the compressor. This high speed flow through the coil 34 ensures that at all times, even at the start of the defrost cycle when the coil is particularly cold, there will only be partial condensation of the refrigerant to liquid, and forceful passage of the resultant mist through the vaporizer, and particularly through the apertures 56 to ensure its impact against the hot wall of the tube 58. The high velocity also ensures that the gas passing from inlet 40 to outlet 46 receives enough heat to fully vaporize any droplets, but does not pick up so much heat from the counterflowing hot gas in the chamber 64 that the compressor becomes overheated. Thus, the vaporizer 42 is very efficient in its vaporizing function, but is a very inefficient counterflow heat exchanger due to its design.

It is important to ensure the re-evaporation of any liquid component in the hot gas fluid, and also to maintain the velocity of the gaseous fluid passing in the circuit as high as possible, especially that of the gaseous fluid passing through the coil 34, so as to maximise the efficiency of the defrost action. Thus, if the velocity through the coil 34 is not maintained at a sufficient level there is a greater tendency for the refrigerant to liquify. This maintenance of the velocity is particularly difficult in close coupled systems, and those with hot gas lines of relatively small bore, and is facilitated by the expansion chamber 71, which provides an enlarged space immediately following the restrictor in which any residual liquid can expand to the vapour state.

The restrictor 70 also renders the system surprisingly self-regulating. During the initial part of the defrost cycle the coil 34 is very cold with frost and ice on its outer surfaces. A greater proportion of the hot defrosting refrigerant passing through the coil 34 condenses to produce a saturated mixture of vapour and droplets. When this saturated mixture goes through the vaporizer and the liquid component is vaporized an almost equal amount of hot vapour in the chamber 64 is condensed, so that the hot refrigerant fluid passing through the orifice 70 is more dense and saturated and a greater weight can pass through to the compressor inlet to result in a higher head pressure during this initial operation. As the coil 34 is warmed less vapour will condense in it, resulting in less vapour condensing in the chamber 64 and a resultant lower density mixture of vapour and liquid passing through the restriction 70. This lower density mixture moves at a slower rate, as measured by weight, through the orifice than the initial high density mixture, so that as the coil becomes cleared of frost less passes through and consequently the suction supply pressure to the compressor decreases, decreasing the compressor head pressure and also decreasing the power required to drive the compressor motor. Moreover, as the defrost period progresses the temperature of the fluid entering the coil increases, which helps to ensure that liquid does not condense in it.

It is found that in the absence of the restriction the vaporizer still functions, but as the coil becomes warmer, because the inlet temperature of the fluid to the coil remains low and does not increase, the time taken for defrost is considerably increased. Moreover, the vaporizer now becomes too effective and the suction pressure increases steadily, causing the compressor motor to eventually draw excessive current.

It will be noted that the specific embodiment described employs a single evaporator coil, but there is no difficulty in the system running out of heat or vapour, so that the compressor becomes starved of vapour to its inlet and cannot work efficiently, since the vaporizer ensures that all of the refrigerant fluid is delivered to the compressor in vapour form. In the absence of the vaporizer the liquid in the fluid would be extracted by the accumulator and return too slowly to the circuit as vapour. Since the compressor is always fully supplied with vapour it operates at high efficiency in compressing and heating the vapour and thus converting electrical energy, appearing as the kinetic energy of the motor, into heat energy for the defrost, and this high efficiency will be maintained even when the coil is heavily iced and consequently causing condensation of a substantial quantity of liquid. It is for this reason also that as the defrost proceeds and the quantity of liquid decreases it is found that the temperature of the hot gas increases. This effect combined with the inherent high efficiency of a hot gas defrost system in delivering the defrost heat directly into the coil results in a system of overall high efficiency.

It is found with the invention that there is no longer any need in a multiple coil system to defrost only one coil at a time, and instead a number of coils can be defrosted simultaneously and in parallel, all of the coils discharging their cooled fluid to a single vaporizer. It will be understood that in a commercial installation employing a large number of coils, it may be preferred to group them in sets, each set being connected to a respective vaporizer.

The following table lists the results of defrost tests done on two similar refrigeration systems A and B that normally operate in parallel. System A was equipped with a vaporizer 42 fitted with an orifice 70, while system B was fitted with a vaporizer without an orifice. Subsequently the tests were rerun with the two vaporizers switched and identical results were obtained. The normal designed full load compressor current is 30.5 amps, and it will be seen that this was never reached with system A had a maximum of 21 amps normal operating current, and the load current progressively decreased as the need for heat decreased. With system B after 17 minutes the current increased rapidly to a value of 26 to 27 amps. Similarly, the normal suction pressure range for these compressors is 40 to 75 p.s.i. and with System A the higher value was not even reached at the start of the cycle, and then decreased progressively, while again the system B reached an overload condition after 17 minutes. System A showed a steady progressive increase in gas temperature into the coil 34, which is desired, while System B showed a very erratic temperature characteristic with a decrease toward the end. System A showed complete defrost in about 12 minutes, compared to the 17 minutes required by system B for an equivalent defrost with greater stress on the compressor and its motor.

TABLE

| Time of Defrost Minutes | System A With Restriction Suction Pressure p.s.i. | Motor Amps | Hot Gas Temp (°F.) | System B Without Restriction Suction Pressure p.s.i. | Motor Amps | Hot Gas Temp (°F.) |
|---|---|---|---|---|---|---|
| | | NORMAL COOLING READINGS | | | | |
| | 48 | 21 | 85 | 46 | 20 | 82 |
| | | DEFROST COOLING READINGS | | | | |
| 01 | 55 | 21 | 122 | 58 | 20 | 81 |
| 02 | 55 | 21 | 137 | 57 | 19 | 58 |
| 03 | 55 | 21 | 143 | 58 | 19 | 52 |
| 04 | 52 | 20.5 | 147 | 58 | 19.5 | 79 |
| 05 | 51 | 20 | 148 | 58 | 19.5 | 92 |
| 07 | 49 | 20 | 149 | 58 | 19.5 | 88 |
| 08 | 48 | 19 | 150 | 58 | 20 | 76 |
| 09 | 47 | 19 | 151 | 58 | 20 | 76 |
| 10 | 47 | 19 | 152 | 58 | 20 | 76 |
| 12 | 46 | 19 | 153 | 59 | 20 | 75 |
| 15 | 45 | 18.5 | 155 | 62 | 21 | 80 |
| 17 | 44 | 18.5 | 156 | 71 | 22.5 | 73 |
| 19 | 44 | 18 | 157 | 81 | 24 | 72 |
| 21 | 43 | 18 | 159 | 95 | 26 | 72 |
| 23 | 42.5 | 18 | 160 | 100 | 27 | 72 |
| 25 | 42.5 | 18 | 161 | 97 | 26 | 71 |
| 27 | 42.5 | 18 | 162 | 98 | 26 | 71 |

In a specific embodiment of a refrigeration system employed for cooling an ice cream cabinet the compressor employed a 1 horsepower motor. The entire vaporizer device had a length of about 75 cm (30 in.). The inner pipe 52 was copper of 15.9 mm (0.625 in.) outside diameter (O.D.) having an internal bore of cross-sectional area of 150.7 sq.mm (0.233 sq.in.), while the external cross-sectional area is 198.5 sq.mm (0.307 sq.in.) The middle pipe 58 was also copper of 22.2 mm (0.875 in.) O.D., having an internal bore of cross-sectional area of 312.9 sq.mm (0.484 sq.in.). The flow cross-sectional area of annular chamber 60 was therefore $$312.9-198.5=114.4 \text{ sq.mm } (0.177 \text{ sq.in.}),$$

or 0.76 times that of the inner pipe 52. The pipe 52 was provided with 24 uniformly distributed holes 56 each of 3.2 mm (0.125 in.) diameter having an area of 7.9 sq.mm (0.0122 sq.in.); the total flow area of the holes was therefore 189 sq.mm (0.294 sq.in.), or 1.25 times that of the pipe 52. The pipe 58 had an outside cross-sectional area of 387.8 sq.mm (0.601 sq.in.), while the outermost pipe 62 had an outside diameter of 28.6 mm (1.125 in.) and an inside bore of flow cross-sectional area of 532.2 sq.mm (0.825 sq.in.), so that the flow cross-sectional area of passage 64 was $$532.2-387.8=144.4 \text{ sq.mm},$$

or 0.96 that of pipe 52.

The flow capacity of chamber 60 is therefore at the low end of the range preferred for the invention, but the total restriction caused by the device is acceptable because of its short length, relative to the length of the other piping in the system. It is for this reason that in some embodiments a reduction of flow capacity between the chambers and the bores of as much as 0.5 can be tolerated, although higher values as indicated are to be preferred. The preferred range of values is 0.9 to 1.2. It will be understood that in commercial practice some variation from the optimum values are acceptable if this permits the use of standard readily available sizes of pipes.

In a heat pump system employing a compressor with a 3 horsepower motor the vaporizer device had a length of 61 cm (24 in.). The inside pipe 52 was of 19 mm (0.75 in.) O.D., the middle pipe 58 was of −28.6 mm (1.125 in.) O.D. and the outside pipe was of 35 mm (1.375 in.) O.D., the inlet and outlet to the chamber 64 both being 16 mm (0.625 in.) diameter. The pipe 52 was provided with 32 holes 56, each of 3.2 mm (0.125 in.) diameter, while the orifice 70 provides a restriction of the outlet 68 to 7.8 mm (0.31 in.),giving an increase in back pressure of about 50%. It will be understood that commercial refrigeration units operate at lower system pressures than domestic units and heat pumps, so that piping of larger diameter is required.

A third specific example is a commercial system employing a compressor driven by a 50 horsepower motor. The device 42 is about 122 cm (−48 in.) in length, with the internal pipe 552 of 6.7 cm (2.625 in.) O.D. provided with 180 holes of 4.6 mm (0.1825 in.) diameter. The middle tube 58 is 9.2 cm (3.625 in.) O.D., while the outer tube is 10.5 cm (4.125 in.) O.D., the inlet 66 and outlet 68 being of 4.1 cm (1.625 in.) diameter. The orifice 70 is of 2.2 cm (0.875 in.) diameter to provide an increase in back pressure of about 50%.

It will be understood by those skilled in the art that there is not necessarily a direct relationship between the reduction in flow cross-section and the pressure drop caused by an orifice, since this will also depend upon other characteristics of the restriction, such as its length. It is found in the application of this invention that a suitable range of back pressure increase for the orifice 70 is from 20% to 70%, while the preferred range is from 40% to 60%.

The size of the expansion chamber 71 is not critical and it will usually be found that the provision of a short length of tube of about 1.5 to 3 times the normal tube diameter is adequate. For example, in a system in which the hot gas line is of 15 mm (0.625 in.) O.D. then the chamber can be a 15 cm (6 ins.) long piece of pipe of 28 mm (1.125 in.) O.D. Again, for example, in a domestic refrigerator in which the hot gas line is about 150 cm (5 ft.) of pipe of 6 mm (0.25 in.) O.D. and 4.75 mm (0.19 in.) I.D. then the expansion chamber can be a piece of pipe 15 cm (6 ins.) long and 15 mm (0.625 in.) O.D.

Figure 3:
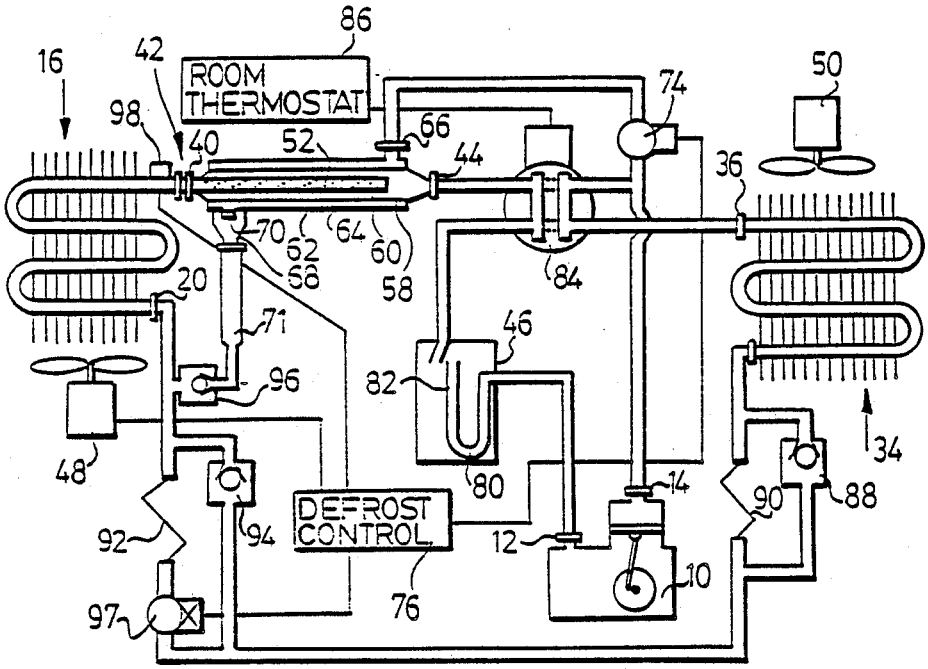
FIG. 3 is a schematic diagram of a heat pump system embodying the invention and employing the vaporizer of FIG. 2.

The invention is of course also applicable to domestic refrigerators which hitherto have normally used electric defrost circuits, but would be much more energy efficient if hot gas defrost could be used. The invention is also particularly applicable to heat pump systems and FIG. 3 shows such a system in heating mode, the system being shifted to air conditioning mode by movement of a solenoid-operated valve 84 from the configuration shown in solid lines to that shown in broken lines. Coil 16 is the outdoor coil which in heating mode is cooled and in air conditioning mode is heated, while coil 34 is the inside coil with which the reverse occurs. When the outside temperature falls below about 8° C. (45° F.) the temperature of coil 16 in heating mode will be cold enough to condense and freeze moisture in the air circulated over it by fan 48, and if this frost is allowed to build up will quickly reduce the unit's efficiency. The most common method of defrosting is simply to reverse the cycle to air conditioning mode by operation for a period of from 2 to 10 minutes of change-over valve 84, every 30 to 90 minutes, depending upon the severity of the icing conditions. This valve is normally under the control of room thermostat 86 which causes it to switch from one mode to the other for heating or cooling as required. This system conceptually is simple but has a number of practical disadvantages and problems.

For example, the hot high pressure refrigerant that has been fed by the compressor to the indoor coil 34 acting as a condenser is now suddenly dumped into the accumulator 46 and then to the compressor inlet 12; there is then a danger of more liquid than can be removed by the accumulator 46 being fed to the compressor causing wear and strain of this expensive component and, shortening its useful life. Again, because the unit is now in air conditioning mode the inside coil 34 is quickly chilled, causing an unpleasant chill to the living area; this is usually compensated by arranging to bypass the room thermostat and bring auxiliary gas or electric heaters into operation, but this involves additional expense and energy comsumption. This practice also does have a danger that the entire system may be locked in the heating condition when the heat pump returns to heating mode with the possibility of overheating and fire; for this reason there is a move by some licensing authorities to ban the practice. The valve 84 is a large, expensive component owing to the high temperatures and fluid pressures involved, and the constant frequent switching required for the defrost cycle considerably reduces its useful life. All of these disadvantages can be avoided by use of a hot gas defrost using the full flow vaporizer device of the invention.

Thus, in heating mode the hot high pressure vapour produced by the compressor 10 is fed via the valve 84 to the indoor coil 34 while hot gas solenoid valve 74 is closed. The vapour condenses in the coil to heat the air passed over the coil by the fan 50, and the condensed refrigerant passes through check valve 88, by-passing expansion device 90 which is illustrated as being a capillary line, but instead can be an orifice or expansion valve of any known kind. The liquid however must pass through similar expansion device 92 and the resultant expanded cooled vapour passes to the outdoor coil 16 to be heated and vaporized by the ambient air. Check valves 94 and 96 ensure respectively that the device 92 is not by-passed, and that the expanded vapour cannot enter the vaporization device 42. The vaporized refrigerant from the coil 16 passes through the device 42 as though it were simply an open part of the compressor suction line tubing, and then passes through valve 84 and the accumulator 46 to the compressor inlet 12 to complete the cycle. The controls required for the operation of the system will be apparent to those skilled in the art and a description thereof is not needed herein for a full explanation of the present invention.

A defrost cycle is initiated by the defrost control 76 without any change required in the position of valve 84, the control switching off the fan motor 48, so that the coil 16 is no longer cooled by the fan, and opening the hot gas valve 74 to admit the hot high pressure refrigerant vapour from the compressor to the chamber 64, as well as to the indoor coil 34. After warming the pipe 58 the hot gas passes through restrictor orifice 70, expansion chamber 71 and check valve 96 to enter the coil 16 and perform its defrost function, as described above with reference to FIGS. 1 and 2. The direct pressure of the hot gas at the end of the restrictor expansion device 92 blocks the flow from the coil 34 so that the refrigerant is trapped in the line between the two restrictions.

A liquid line solenoid 97 is installed ahead of the expansion device 92 and is closed during the defrost period to prevent the liquid refrigerant in the line expanding into the outside coil 16, which would reduce the defrost efficiency. The operation of the device 42, the orifice 70 and the expansion chamber 71 is exactly as described above, the gas from the outlet 44 passing through valve 84 and accumlator 46 to the suction inlet 12 of the compressor. After a predetermined period of time set by the defrost control 76, with or without an override temperature control provided by a thermostat 98 adjacent to the coil outlet 18, whichever arrangement is preferred to ensure that defrosting is complete, the valve 74 is closed to stop the direct flow of hot gas to the vaporizer 42 and coil 16. The solenoid valve 97 is opened and the fan motor 48 is restarted. The system then returns to its normal heating cycle, again without shift of the valve 84, and without the many disadvantages described above.

Although in both the embodiments described herein the orifice or restriction 70 is illustrated as attached directly to the body of the vaporizer 42, this is not essential and it will function equally effectively as a separate item. As before, it also operates with the vaporizer to provide automatic limiting and self-regulation. A greater weight of refrigerant can flow per unit time through a fixed restriction when in liquid form rather than in vapour form, and the amount of heat transfer depends upon the weight of refrigerant pumped per minute, and not the volume, which is constant. At the beginning of the defrost period there is little condensation in chamber 64 and so little liquid to pass through the restriction; initially therefore there is a lower gas velocity through the outdoor coil, which is desirable since the coil is relatively full of liquid refrigerant and too high a pressure and gas velocity would discharge this liquid too quickly ad overload the vaporizer. As with the refrigeration system the accumulator 46 is provided in case this does happen and to try to prevent the initial spurt of liquid from reaching the compressor and damaging it.

As this initial flow of liquid vaporizes in chamber 60 it causes condensation of substantially an equal amount of liquid in chamber 64, so that a greater weight of refrigerant passes through the restriction 70. Once past the restriction this additional liquid vaporizes due to pressure reduction, especially when an expansion chamber 71 is provided for this purpose, increasing the gas velocity through the coil 16 to ensure that only a portion of this vapour condenses therein as the result of the defrosting. As the coil is cleared of frost and becomes warmer a smaller quantity of the hot defrosting gas condenses, so that less condenses in chamber 62, therefore less passes through the restriction and there is less evaporation beyond the restriction, resulting in the above-described beneficial supply of cooler gas at lower suction pressure to the compressor. It will be seen that the poor heat exchange characteristic of the vaporizer is desirable, since an efficient exchanger would result in delivery of hotter gas to the compressor with increased possibility of overheating and damage thereto.

The vaporizer is inoperative when the system is in air conditioning or cooling mode serving as part of the compressor discharge line due to the vaporizer 42 being able to pass refrigerant flow equally in either direction and description of the cycle in that mode is therefore not required, except to point out that the expansion device 90 is now operative while the device 92 is bypassed by check valve 94.

Figure 4:
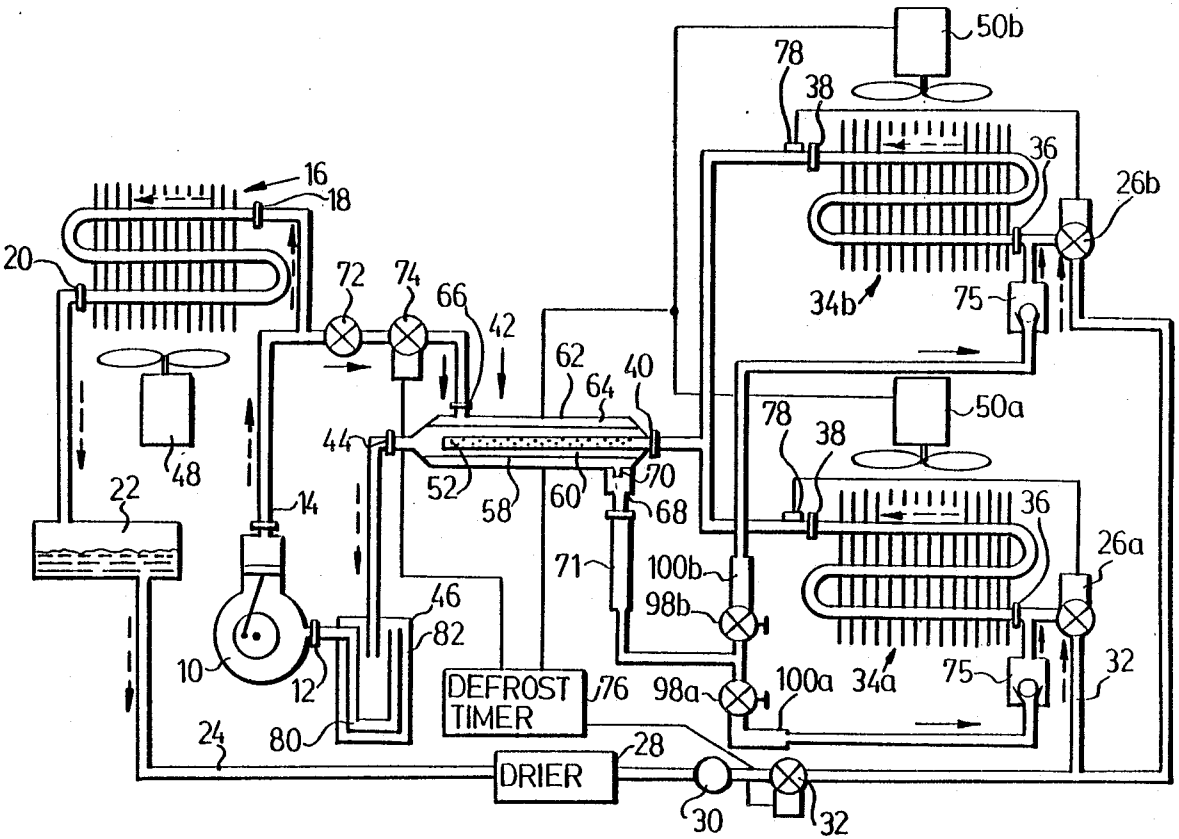
FIG. 4 is a schematic diagram of a multiple evaporator system embodying the invention also employing the vaporizer of FIG. 2.

FIG. 4 illustrates in more detail the application of the invention to a multiple evaporator system, two evaporators 34*a* and 34*b* being illustrated. However, it is usual in commercial installations for many more than two evaporators to be required, and installations with as many as 16 separate similar evaporators are not unusual. It is extremely difficult with such installations employing hot gas defrost to ensure that all of the evaporators are defrosted equally efficiently, so that the defrost period must be made long enough to suit the slowest defrosting unit. A principal reason for this difference is the difference in length of the hot gas lines leading to the evaporators, resulting in different pressure drop. A solution employed in the past is to make all of the pipes of the same length, as long as the longest pipe, but this involves complex and expensive arrangements with some pipes folded back upon themselves many times, so as to accommodate them in the available space.

Figure 5:
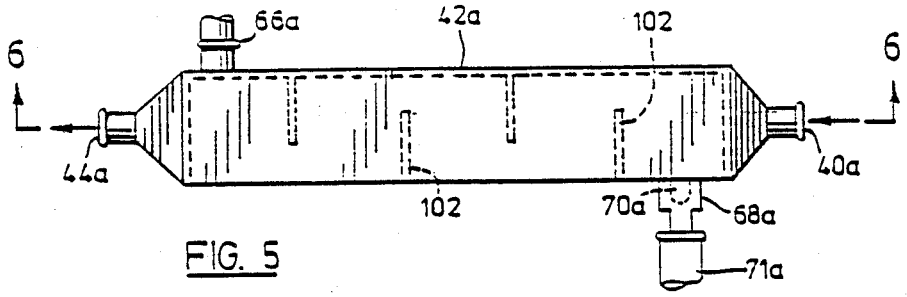
FIG. 5 is a plan view of a rectangular configuration vaporizer which is a second embodiment of the invention.
Figure 6:
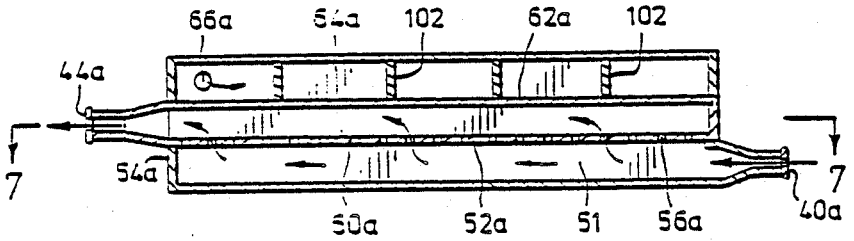
FIG. 6 is a longitudinal cross-section through the vaporizer of FIG. 5, taken on the line 6—6 therein.
Figure 7:
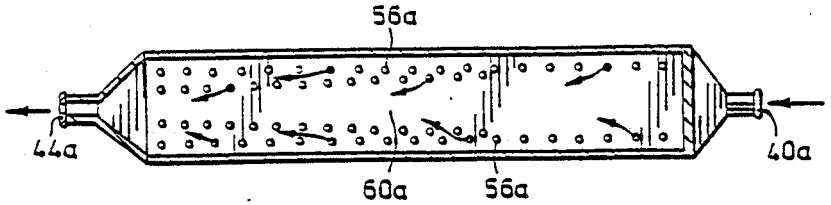
FIG. 7 is a longitudinal cross-section through the vaporizer of FIG. 5, taken on the line 7—7 of FIG. 6.

This is avoided with a system of the invention, as illustrated by FIG. 4, in which the evaporator 42 is provided with a fixed restrictor 70 immediately adjacent its outlet 68 and an expansion chamber 71, which are therefore common to all of the evaporators 34*a*, 34*b*, etc. Each evaporator is also provided with its own respective adjustable restrictor 98*a*, 98*b*, etc., and its own respective downstream expansion chamber 100*a*, 100*b*. The gas lines are all run from the evaporator as directly and structurally simply as possible, using common pipes and manifolds wherever possible, and without any unnecessary loops, etc. Once installed their effective lengths are relatively easily adjusted to be equal by adjustment of the restrictors 98*a*, 98*b*, etc , thereby adjusting the back-pressures until they are at least approximately equal. With such a system the greater closure of the restrictors associated with the shorter lines to increase the effective back pressure in the respective line has the effect of diverting the hot gas thus throttled to the other evaporators, so that the system is overall more efficient than one in which most of the lines have been artificially extended in length to make them all equal The concentric tubular structure of FIG. 2 is relatively simple to manufacture especially since, as indicated above, the different sizes of tubes required can be selected from those already commercially available. The invention is not however limited to such a tubular structure and an alternative structure of generally rectangular configuration in both plan and side elevation is illustrated by FIGS. 5–7. The same reference numerals will be used as with the embodiment of FIG. 2 for equivalent parts, but with the suffix a. Thus, the refrigerant inlet 40*a* of the vaporizer 42*a* feeds into a first chamber 51 which is closed at its other end by wall 54*a*, while the outlet 44*a* discharges from a second chamber 60*a*. The two chambers have a first flat wall 52*a* (corresponding to the cylindrical wall of the pipe 52 in FIG. 2) in common between them, and this wall is provided with a plurality of apertures 56*a* of the required flow capacity. A third chamber 64*a* has a second wall 62*a* in common with itself and the chamber 60*a*, and has the hot gas inlet 66*a* at one end and the outlet 68*a* at the other end, the outlet being shown as provided with a respective restriction 70*a* and expansion chamber 71*a*.

The three chambers 51, 60*a* and 64*a* constitute respective first, second and third flow passages, whose flow cross-sectional areas and capacities are predetermined as with the first-described embodiment. Similarily, the number and size of the holes 56*a* are suitably chosen, as is the spacing between the two common walls 52*a* and 62*a*, so that the flow of refrigerant fluid is directed by the holes 52*a* against the heated wall 62*a* so as to ensure full vaporization. The chamber 64*a* is provided with internal baffles 102 forming a tortuous path to ensure that the hot fluid does not pass directly from the inlet 66*a* to the outlet 68*a* facilitating uniform heating of the wall 62*a*. Similarily, the holes 56*a* may be provided in a pattern that faciliates more even distribution of the flow of fluid through them; for this purpose in this embodiment fewer holes are provided adjacent the inlet 40*a*, and their number increase progressively toward the outlet 44*a*. A similar effect can be achieved, if desired, with the embodiment of FIG. 2 by providing a tapered space-filling rod 104 inside the pipe 52 concentric therewith.

It will be seen that with the hot gas defrost systems of the invention the energy required for defrost is supplied by the compressor motor to the refrigerant as sensible heat, and from the refrigerant directly to the pipe or pipes of the coil and outwardly therefrom to the fins which are in intimate heat exchange contact with the pipe. This effectively provides the defrosting heat at the precise same location in the coil as heat is withdrawn during cooling and maximum defrosting efficiency is thereby obtained, with the full flow vaporizer providing a constant supply of cool refrigerant vapour to the compressor to be compressed and heated as long as it is required.

I claim:

1. A liquid refrigerant vaporizer for use in a refrigeration system employing hot refrigerant fluid to defrost a coil or coils thereof, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow area of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith; and a refrigerant fluid flow restriction at or connected to the third flow passage outlet for producing an increase in back pressure of the refrigerant fluid in the second flow passage.

2. A vaporizer as claimed in claim 1, wherein the said first, second and third flow passages are of rectangular configuration in plan and side elevation, and the said first and second common walls between the respective chambers are flat.

3. A vaporizer as claimed in claim 1, wherein the total flow area provided by all of the bores is not more than 1.5 times the cross-sectional flow area of the first flow passage.

4. A vaporizer as claimed in claim 3, wherein the total flow area provided by all of the said bores is between 0.9 and 1.2 times the cross-sectional flow area of the first flow passage.

5. A vaporizer as claimed in claim 1, wherein the said bores are of flow area from 8 to 18 sq.mm (0.012 to 0.028 sq.in.) and the total flow area of all of the bores is adjusted by adjustment of the number of bores.

6. A vaporizer as claimed in claim 1, wherein the cross-sectional flow area of the second flow passage is between 0.5 and 1.5 times the corresponding area of the first flow passage.

7. A vaporizer as claimed in claim 6, wherein the cross-sectional flow area of the second flow passage is between 0.9 and 1.2 times the corresponding area of the first flow passage.

8. A vaporizer as claimed in claim 1, wherein the cross-sectional flow area of the third flow passage is between 0.5 and 1.5 times the corresponding flow area of the refrigerant system discharge line from the compressor outlet.

9. A vaporizer as claimed in claim 8, wherein the cross-sectional flow area of the third flow passage is between 0.9 and 1.2 times the corresponding flow area of the refrigerant system discharge line from the compressor outlet.

10. A hot refrigerant fluid defrost system for use in a refrigeration system for defrost of a coil or coils thereof, the system comprising:

a controllable flow valve adapted for connection to the outlet of a compressor pump to receive hot compressed refrigerant fluid therefrom;

a coil to be defrosted having an inlet and an outlet; and a liquid refrigerant vaporizer connected to the coil for vaporizing liquid fluid issuing from the coil outlet to prevent its delivery to the compressor inlet, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow are of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith, the inlet being connected to the said controllable flow valve for the flow therethrough to be controlled by the valve, and the outlet being connected to the coil inlet for delivery of the fluid thereto; and a refrigerant fluid flow restriction at or connected to the third flow passage outlet for producing an increase in back pressure of the refrigerant fluid in the second flow passage.

11. A defrost system as claimed in claim 10, wherein the said first, second and third flow passages are of rectangular configuration in plan and side elevation, and the said first and second common walls between the respective chambers are flat.

12. A defrost system as claimed in claim 10, wherein the total flow area provided by all of the bores is not more than 1.5 times the cross-sectional flow area of the first flow passage.

13. A defrost system as claimed in claim 12, wherein the total flow area provided by all of the said bores is between 0.9 and 1.2 times the cross-sectional flow area of the first flow passage.

14. A defrost system as claimed in claim 10, wherein the said bores are of flow area from 8 to 18 sq.mm (0.012 to 0.028 sq.in.) and the total flow area of all of the bores is adjusted by adjustment of the number of bores.

15. A defrost system as claimed in claim 10, wherein the cross-sectional flow area of the second flow passage is between 0.5 and 1.5 times the corresponding area of the first flow passage.

16. A defrost system as claimed in claim 15, wherein the cross-sectional flow area of the second flow passage is between 0.9 and 1.2 times the corresponding area of the first flow passage.

17. A defrost system as claimed in claim 10, wherein the cross-sectional flow area of the third flow passage is between 0.5 and 1.5 times the corresponding flow area of the refrigerant system discharge flow line from the compressor outlet.

18. A defrost system as claimed in claim 17, wherein the cross-sectional flow area of the third flow passage is between 0.9 and 1.2 times the corresponding flow area of the refrigerant system discharge line from the compressor outlet.

19. A defrost system as claimed in claim 10, wherein the system is incorporated in a heat pump.

20. A defrost system as claimed in claim 10, and comprising a plurality of coils to be defrosted, wherein there is provided a single vaporizer connected to all of the coil outlets to receive refrigerant therefrom.

21. A refrigeration system comprising:

a refrigerant compressor;

a cooling coil having an inlet and an outlet;

an expansion device for expanding and cooling refrigerant connected between the compressor and the cooling coil inlet;

a controllable defrost control valve connected to the compressor outlet to receive hot compressed refrigerant fluid therefrom;

and a liquid refrigerant vaporizer connected to the coil for vaporizing liquid fluid issuing from the coil outlet to prevent its delivery to the compressor inlet, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow are of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith, the inlet being connected to the said controllable flow valve for the flow therethrough to be controlled by the valve, and the outlet being connected to the coil inlet for delivery of the fluid thereto; and a refrigerant fluid flow restriction at or connected to the third flow passage outlet for producing an increase in back pressure of the refrigerant fluid in the second flow passage.

22. A refrigeration system as claimed in claim 21, wherein the said first, second and third flow passages are of rectangular configuration in plan and side elevation, and the said first and second common walls between the respective chambers are flat.

23. A refrigeration system as claimed in claim 21, wherein the total flow area provided by all of the bores is not more than 1.5 times the cross-sectional flow area of the first flow passage.

24. A refrigeration system as claimed in claim 23, wherein the total flow area provided by all of the said bores is between 0.9 and 1.2 times the cross-sectional flow area of the first flow passage.

25. A refrigeration system as claimed in claim 21, wherein the said bores are of flow area from 8 to 18 sq.mm (0.012 to 0.028 sq.in.) and the total flow area of all of the bores is adjusted by adjustment of the number of bores.

26. A refrigeration system as claimed in claim 21, wherein the cross-sectional flow area of the second flow passage is between 0.5 and 1.5 times the corresponding area of the first flow passage.

27. A refrigeration system as claimed in claim 26, wherein the cross-sectional flow area of the second flow passage is between 0.9 and 1.2 times the corresponding area of the first flow passage.

28. A refrigeration system as claimed in claim 21, wherein the cross-sectional flow area of the third annular flow passage is between 0.5 and 1.5 times the corresponding flow area of the refrigerant system discharge flow line from the compressor outlet.

29. A refrigeration system as claimed in claim 28, wherein the cross-sectional flow area of the third annular flow passage is between 0.9 and 1.2 times the corresponding flow area of the refrigerant system discharge line from the compressor outlet.

30. A refrigeration system as claimed in claim 21 and incorporated into a heat pump.

31. A refrigeration system as claimed in claim 21, and comprising a plurality of coils to be defrosted, wherein there is provided a single vaporizer connected to all of the coil outlets to receive refrigerant therefrom.

32. A liquid refrigerant vaporizer for use in a refrigeration system employing hot refrigerant fluid to defrost a coil or coils thereof, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow area of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith;

a refrigerant fluid flow restriction at or connected to the third flow passage outlet for producing an increase in back pressure of the refrigerant fluid in the second flow passage; and an expansion chamber connected to the outlet of the flow restriction immediately downstream thereof for re-evaporation of liquid refrigerant that has passed through the flow restriction.

33. A vaporizer as claimed in claim 32, wherein the said first, second and third flow passages are of rectangular configuration in plan and side elevation, and the said first and second common walls between the respective chambers are flat.

34. A vaporizer as claimed in claim 32, wherein the total flow area provided by all of the bores is not more than 1.5 times the cross-sectional flow area of the first flow passage.

35. A vaporizer as claimed in claim 34, wherein the total flow area provided by all of the said bores is between 0.9 and 1.2 times the cross-sectional flow area of the first flow passage.

36. A vaporizer as claimed in claim 32, wherein the said bores are of flow area from 8 to 18 sq.mm (0.012 to 0.028 sq.in.) and the total flow area of all of the bores is adjusted by adjustment of the number of bores.

37. A vaporizer as claimed in claim 32, wherein the cross-sectional flow area of the second flow passage is between 0.5 and 1.5 times the corresponding area of the first flow passage.

38. A vaporizer as claimed in claim 37, wherein the cross-sectional flow area of the second flow passage is between 0.9 and 1.2 times the corresponding area of the first flow passage.

39. A vaporizer as claimed in claim 32, wherein the cross-sectional flow area of the third flow passage is between 0.5 and 1.5 times the corresponding flow area of the refrigerant system discharge line from the compressor outlet.

40. A vaporizer as claimed in claim 39, wherein the cross-sectional flow area of the third flow passage is between 0.9 and 1.2 times the corresponding flow area of the refrigerant system discharge line from the compressor outlet.

41. A hot refrigerant fluid defrost system for use in a refrigeration system for defrost of a coil or coils thereof, the system comprising:

a controllable flow valve adapted for connection to the outlet of a compressor pump to receive hot compressed refrigerant fluid therefrom;

a coil to be defrosted having an inlet and an outlet; and a liquid refrigerant vaporizer connected to the coil for vaporizing liquid fluid issuing from the coil outlet to prevent its delivery to the compressor inlet, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow are of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith, the inlet being connected to the said controllable flow valve for the flow therethrough to be controlled by the valve, and the outlet being connected to the coil inlet for delivery of the fluid thereto;

a refrigerant fluid flow restriction at or connected to the third flow passage outlet for producing an increase in back pressure of the refrigerant fluid in the second flow passage; and an expansion chamber connected to the outlet of the flow restriction immediately downstream thereof for re-evaporation of liquid refrigerant that has passed through the flow restriction.

42. A defrost system as claimed in claim 41, wherein the said first, second and third flow passages are of rectangular configuration in plan and side elevation, and the said first and second common walls between the respective chambers are flat.

43. A defrost system as claimed in claim 41, wherein the total flow area provided by all of the bores is not more than 1.5 times the cross-sectional flow area of the first flow passage.

44. A defrost system as claimed in claim 43, wherein the total flow area provided by all of the said bores is between 0.9 and 1.2 times the cross-sectional flow area of the first flow passage.

45. A defrost system as claimed in claim 41, wherein the said bores are of flow area from 8 to 18 sq.mm (0.012 to 0.028 sq.in.) and the total flow area of all of the bores is adjusted by adjustment of the number of bores.

46. A defrost system as claimed in claim 41, wherein the cross-sectional flow area of the second flow passage is between 0.5 and 1.5 times the corresponding area of the first flow passage.

47. A defrost system as claimed in claim 46, wherein the cross-sectional flow area of the second flow passage is between 0.9 and 1.2 times the corresponding area of the first flow passage.

48. A defrost system as claimed in claim 41, wherein the cross-sectional flow area of the third flow passage is between 0.5 and 1.5 times the corresponding flow area of the refrigerant system discharge flow line from the compressor outlet.

49. A defrost system as claimed in claim 48, wherein the cross-sectional flow area of the third flow passage is between 0.9 and 1.2 times the corresponding flow area of the refrigerant system discharge line from the compressor outlet.

50. A defrost system as claimed in claim 41, wherein the system is incorporated in a heat pump.

51. A defrost system as claimed in claim 41, and comprising a plurality of coils to be defrosted, wherein there is provided a single vaporizer connected to all of the coil outlets to receive refrigerant therefrom.

52. A refrigeration system comprising:

a refrigerant compressor;

a cooling coil having an inlet and an outlet;

an expansion device for expanding and cooling refrigerant connected between the compressor and the cooling coil inlet;

a controllable defrost control valve connected to the compressor outlet to receive hot compressed refrigerant fluid therefrom;

and a liquid refrigerant vaporizer connected to the coil for vaporizing liquid fluid issuing from the coil outlet to prevent its delivery to the compressor inlet, the vaporizer comprising:

first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil under defrost, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow are of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith, the inlet being connected to the said controllable flow valve for the flow therethrough to be controlled by the valve, and the outlet being connected to the coil inlet for delivery of the fluid thereto;

a refrigerant fluid flow restriction at or connected to the third flow passage outlet for producing an increase in back pressure of the refrigerant fluid in the second flow passage; and an expansion chamber connected to the outlet of the flow restriction immediately downstream thereof for re-evaporation of liquid refrigerant that has passed through the flow restriction.

53. A refrigeration system as claimed in claim 52, wherein the said first, second and third flow passages are of rectangular configuration in plan and side elevation, and the said first and second common walls between the respective chambers are flat.

54. A refrigeration system as claimed in claim 52, wherein the total flow area provided by all of the bores is not more than 1.5 times the cross-sectional flow area of the first flow passage.

55. A refrigeration system as claimed in claim 54, wherein the total flow area provided by all of the said bores is between 0.9 and 1.2 times the cross-sectional flow area of the first flow passage.

56. A refrigeration system as claimed in claim 52, wherein the said bores are of flow area from 8 to 18 sq.mm (0.012 to 0.028 sq.in.) and the total flow area of all of the bores is adjusted by adjustment of the number of bores.

57. A refrigeration system as claimed in claim 52, wherein the cross-sectional flow area of the second flow passage is between 0.5 and 1.5 times the corresponding area of the first flow passage.

58. A refrigeration system as claimed in claim 57, wherein the cross-sectional flow area of the second flow passage is between 0.9 and 1.2 times the corresponding area of the first flow passage.

59. A refrigeration system as claimed in claim 52, wherein the cross-sectional flow area of the third annular flow passage is between 0.5 and 1.5 times the corresponding flow area of the refrigerant system discharge flow line from the compressor outlet.

60. A refrigeration system as claimed in claim 59, wherein the cross-sectional flow area of the third annular flow passage is between 0.9 and 1.2 times the corresponding flow area of the refrigerant system discharge line from the compressor outlet.

61. A refrigeration system as claimed in claim 52 and incorporated into a heat pump.

62. A refrigeration system as claimed in claim 52, and comprising a plurality of coils to be defrosted, wherein there is provided a single vaporizer connected to all of the coil outlets to receive refrigerant therefrom.

63. A liquid refrigerant vaporizer for use in a refrigeration system employing hot refrigerant fluid to defrost a coil or coils thereof, the vaporizer comprising:

first inner, second middle and third outer pipes mounted one within the other to provide a first inner flow passage in the first inner pipe, a second annular flow passage between the first inner and second middle pipes, and a third annular flow passage between the second middle and third outer pipes;

wherein the first inner pipe is adapted for connection at one end into the refrigeration system so as to receive refrigerant fluid exiting from the coil under defrost, is closed at the other end, and is provided in its wall with a plurality of bores distributed along its length so that the refrigerant fluid flowing therein exits therefrom through the bores to impinge against the inner wall of the second middle pipe for heat exchange therewith;

wherein the total flow area provided by all of the said bores is at least 0.5 times the cross-sectional flow area of the first inner flow passage;

wherein the second middle pipe is of heat conductive material, the second annular flow passage is closed at one end and is adapted for connection at its other end into the refrigeration system for delivery of the refrigerant fluid therefrom;

wherein the cross-sectional flow area of the said second annular flow passage is at least 0.5 times the cross-sectional flow are of the first inner flow passage; and wherein the third annular flow passage has an inlet thereto and an outlet therefrom for the hot refrigerant fluid, the inlet and the outlet being spaced from one another for the hot refrigerant fluid to contact the outer wall of the second middle pipe for vaporization thereby;

a refrigerant fluid flow restriction at or connected to the third annular flow passage outlet for producing an increase in back pressure of the refrigerant fluid in the second annular flow passage; and an expansion chamber connected to the outlet of the flow restriction immediately downstream thereof for re-evaporation of liquid refrigerant that has passed through the flow restriction.

64. A refrigerant vaporizer as claimed in claim 63, wherein the expansion chamber comprises a piece of pipe of between 1.5 and 3 times the diameter of the hot gas line in which it is connected.

65. A refrigerant vaporizer as claimed in claim 63, wherein the increase in back pressure produced by the fluid flow restriction is between 20% and 70% of the pressure in the absence of the fluid flow restriction.

66. A refrigerant vaporizer as claimed in claim 63, wherein the total flow area provided by all of the bores is not more than 1.5 times the cross-sectional flow area of the first annular flow passage.

67. A refrigerant vaporizer as claimed in claim 66, wherein the total flow area provided by all of the said bores is between 0.9 and 1.2 times the cross-sectional flow area of the first inner flow passage.

68. A refrigerant vaporizer as claimed in claim 63, wherein the first, second and third pipes are all of circular cross-section and are concentric with one another.

69. A refrigerant vaporizer as claimed in claim 63, wherein the said bores are of flow area from 8 to 18 sq.mm (0.012 to 0.028 sq.in.) and the total flow area of all of the bores is adjusted by adjustment of the number of bores.

70. A refrigerant vaporizer as claimed in claim 63, wherein the fluid flow restrictor is directly attached to the third outer pipe at the outlet therefrom, and the expansion chamber is directly attached to the fluid flow restrictor.

71. A refrigerant vaporizer as claimed in claim 63, wherein the cross-sectional flow area of the second annular flow passage is between 0.5 and 1.5 times the corresponding area of the first innermost flow passage.

72. A refrigerant vaporizer as claimed in claim 71, wherein the cross-sectional flow area of the second annular flow passage is between 0.9 and 1.2 times the corresponding area of the first innermost flow passage.

73. A refrigerant vaporizer as claimed in claim 63, wherein the cross-sectional flow area of the third outermost annular flow passage is between 0.5 and 1.5 times the corresponding flow area of the refrigerant system dischargeline from the compressor outlet.

74. A refrigerant vaporizer as claimed in claim 72, wherein the cross-sectional flow area of the third outermost annular flow passage is between 0.9 and 1.2 times the corresponding flow area of the refrigerant system dischargeline from the compressor outlet.

75. A hot refrigerant fluid defrost system for use in a refrigeration system for defrost of a coil or coils thereof, the system comprising:

a controllable flow valve adapted for connection to the outlet of a compressor pump to receive hot compressed refrigerant fluid therefrom;

a coil to be defrosted having an inlet and an outlet; and a liquid refrigerant vaporizer connected to the coil for vaporizing liquid fluid issuing from the coil outlet to prevent its delivery to the compressor inlet, the vaporizer comprising first inner, second middle and third outer pipes mounted one within the other to provide a first inner flow passage in the first inner pipe, a second annular flow passage between the first inner and second middle pipes, and a third annular flow passage between the second middle and third outer pipes;

wherein the first inner pipe is adapted for connection at one end to the coil outlet so as to receive the fluid exiting from the coil, is closed at the other end, and is provided in its wall with a plurality of bores distributed along its length so that the refrigerant fluid flowing therein exits therefrom through the bores to impinge against the inner wall of the second middle pipe for vaporization thereby;

wherein the total flow area provided by all of the said bores is between 0.5 and 1.5 times the cross-sectional flow area of the first inner flow passage;

wherein the second middle pipe is of heat conductive material, the first annular flow passage is closed at one end and is adapted for connection at its other end into the refrigeration system for delivery of the refrigerant fluid therefrom;

wherein the cross-sectional flow area of the said second annular flow passage is at least 0.5 times the cross-sectional flow are of the first inner flow passage; and wherein the third annular flow passage has an inlet thereto and an outlet therefrom for the hot refrigerant fluid, the inlet and the outlet being spaced from one another for the hot refrigerant fluid to contact the outer wall of the second middle pipe for heat exchange therewith, the inlet being connected to the said controllable flow valve for the flow therethrough to be controlled by the valve, and the outlet being connected to the coil inlet for delivery of the fluid thereto;

a refrigerant fluid flow restriction at or connected to the third annular flow passage outlet for producing an increase in back pressure of the refrigerant fluid in the third annular flow passage; and an expansion chamber connected to the outlet of the flow restriction immediately downstream thereof for re-evaporation of liquid refrigerant that has passed through the flow restriction.

76. A system as claimed in claim 75, wherein the expansion chamber comprises a piece of pipe of between 1.5 and 3 times the diameter of the hot gas line in which it is connected.

77. A system as claimed in claim 75, wherein the increase in back pressure produced by the fluid flow restriction is between 20% and 70% of the pressure in the absence of the fluid flow restriction.

78. A system as claimed in claim 75, wherein the total flow area provided by all of the bores is not more than 1.5 times the cross-sectional flow area of the first annular flow passage.

79. A system as claimed in claim 78, wherein the total flow area provided by all of the said bores is between 0.9 and 1.2 times the cross-sectional flow area of the first inner flow passage.

80. A system as claimed in claim 75, wherein the said bores are of flow area from 8 to 18 sq.mm (0.012 to 0.028 sq.in.) and the total flow area of all of the bores is adjusted by adjustment of the number of bores.

81. A system as claimed in claim 75, wherein the first, second and third pipes are all of circular cross-section and are concentric with one another.

82. A system as claimed in claim 75, wherein the fluid flow restrictor is directly attached to the third outer pipe at the outlet therefrom, and the expansion chamber is directly attached to the fluid flow restrictor.

83. A system as claimed in claim 75, wherein the cross-sectional flow area of the second annular flow passage is between 0.5 and 1.5 times the corresponding area of the first innermost flow passage.

84. A system as claimed in claim 83, wherein the cross-sectional flow area of the second annular flow passage is between 0.9 and 1.2 times the corresponding area of the first innermost flow passage.

85. A system as claimed in claim 75, wherein the cross-sectional flow area of the third outer annular flow passage is between 0.5 and 1.5 times the corresponding flow area of the refrigerant system discharge flow line from the compressor outlet.

86. A system as claimed in claim 85, wherein the cross-sectional flow area of the third outermost annular flow passage is between 0.9 and 1.2 times the corresponding flow area of the refrigerant system discharge-line from the compressor outlet.

87. A system as claimed in claim 75, wherein the refrigeration system is incorporated in a heat pump.

88. A system as claimed in claim 75, and comprising a plurality of coils to be defrosted, wherein there is provided a single vaporizer connected to all of the coil outlets to receive refrigerant therefrom.

89. A refrigeration system comprising:

a refrigerant compressor;

a cooling coil having an inlet and an outlet;

an expansion device for expanding and cooling refrigerant connected between the compressor and the cooling coil inlet;

a controllable defrost control valve connected to the compressor outlet to receive hot compressed refrigerant fluid therefrom;

and a liquid refrigerant vaporizer connected to the coil for vaporizing liquid fluid issuing from the coil outlet to prevent its delivery to the compressor inlet, the vaporizer comprising first inner, second middle and third outer pipes mounted one within the other to provide a first innermost flow passage in the first inner pipe, a second annular flow passage between the first inner and second middle pipes, and a third annular flow passage between the second middle and third outer pipes;

wherein the first inner pipe is adapted for connection at one end to the coil outlet so as to receive the fluid exiting from the coil, is closed at the other end, and is provided in its wall with a plurality of bores distributed along its length so that the refrigerant fluid flowing therein exits therefrom through the bores to impinge against the inner wall of the second middle pipe for vaporization thereby;

wherein the total flow area provided by all of the said bores is between 0.5 and 1.5 times the cross-sectional flow area of the first inner flow passage;

wherein the second middle pipe is of heat conductive material, the first annular flow passage is closed at one end and is adapted for connection at its other end into the refrigeration system for delivery of the refrigerant fluid therefrom;

wherein the cross-sectional flow area of the said second annular flow passage is at least 0.5 times the cross-sectional flow area of the first inner flow passage; and wherein the third annular flow passage has an inlet thereto and an outlet therefrom for the hot refrigerant fluid, the inlet and the outlet being spaced from one another for the hot refrigerant fluid to contact the outer wall of the second middle pipe for heat exchange therewith, the inlet being connected to the said controllable flow valve for the flow therethrough to be controlled by the valve, and the outlet being connected to the coil inlet for delivery of the fluid thereto;

a refrigerant fluid flow restriction at or connected to the third annular flow passage outlet for producing an increase in back pressure of the refrigerant fluid in the third annular flow passage; and an expansion chamber connected to the outlet of the flow restriction immediately downstream thereof for re-evaporation of liquid refrigerant that has passed through the flow restriction.

90. A system as claimed in claim 89, wherein the expansion chamber comprises a piece of pipe of between 1.5 and 3 times the diameter of the hot gas line in which it is connected.

91. A system as claimed in claim 89, wherein the increase in back pressure produced by the fluid flow restriction is between 20% and 70% of the pressure in the absence of the fluid flow restriction.

92. A system as claimed in claim 89, wherein the total flow area provided by all of the bores is not more than 1.5 times the cross-sectional flow area of the first annular flow passage.

93. A system as claimed in claim 92, wherein the total flow area provided by all of the said bores is between 0.9 and 1.2 times the cross-sectional flow area of the first inner flow passage.

94. A system as claimed in claim 89, wherein the first, second and third pipes are all of circular cross-section and are concentric with one another.

95. A system as claimed in claim 89, wherein the said bores are of flow area from 8 to 18 sq.mm (0.012 to 0.028 sq.in.) and the total flow area of all of the bores is adjusted by adjustment of the number of bores.

96. A system as claimed in claim 89, wherein the fluid flow restrictor is directly attached to the third outer pipe at the outlet therefrom.

97. A system as claimed in claim 89, wherein the cross-sectional flow area of the second annular flow passage is between 0.5 and 1.5 times the corresponding area of the first innermost flow passage.

98. A system as claimed in claim 97, wherein the cross-sectional flow area of the second annular flow passage is between 0.9 and 1.2 times the corresponding area of the first innermost flow passage.

99. A system as claimed in claim 89, wherein the cross-sectional flow area of the third outermost annular flow passage is between 0.5 and 1.5 times the corresponding flow area of the refrigerant system discharge flow line from the compressor outlet.

100. A system as claimed in claim 99, wherein the cross-sectional flow area of the third outermost annular flow passage is between 0.9 and 1.2 times the corresponding flow area of the refrigerant system discharge-line from the compressor outlet.

101. A refrigeration system as claimed in claim 89 and incorporated into a heat pump.

102. A system as claimed in claim 89, and comprising a plurality of coils to be defrosted, wherein there is provided a single vaporizer connected to all of the coil outlets to receive refrigerant therefrom.

103. A hot refrigerant fluid defrost system for use in a refrigeration system including a plurality of parallel-connected cooling coils to be defrosted, each coil having an inlet and an outlet; the system comprising:

a controllable flow valve adapted for connection to the outlet of a compressor pump to receive hot compressed refrigerant fluid therefrom;

the plurality of parallel-connected cooling coils and a liquid refrigerant vaporizer connected to the coil outlets for vaporizing liquid fluid issuing therefrom to prevent its delivery to the compressor inlet, the vaporizer comprising first inner, second middle and third outer pipes mounted one within the other to provide a first inner flow passage in the first inner pipe, a second annular flow passage between the first inner and a second middle pipes, and a third annular flow passage between the second middle and third outer pipes;

wherein the first inner pipe is adapted for connection at one end to the coil outlets so as to receive the fluid exiting from the coils, is closed at the other end, and is provided in its wall with a plurality of bores distributed along its length so that the refrigerant fluid flowing therein exits therefrom through the bores to impinge against the inner wall of the second middle pipe for heat exchange therewith;

wherein the total flow area provided by all of the said bores is between 0.5 and 1.5 times the cross-sectional flow area of the first inner flow passage;

wherein the second middle pipe is of heat conductive material, the first annular flow passage is closed at one end and is adapted for connection at its other end into the refrigeration system for delivery of the refrigerant fluid therefrom;

wherein the cross-sectional flow area of the said second annular flow passage is at least 0.5 times the cross-sectional flow area of the first inner flow passage; and wherein the third annular flow passage has an inlet thereto and an outlet therefrom for the hot refrigerant fluid, the inlet and the outlet being spaced from one another for the hot refrigerant fluid to contact the outer wall of the second middle pipe for heat exchange therewith, the inlet being connected to the said controllable flow valve for the flow therethrough to be controlled by the valve, and the outlet being connected to the coil inlets for delivery of the fluid thereto; and a corresponding plurality of refrigerant fluid flow restrictions of controllable flow capacity, one for each of said plurality of coils, each connected between the inlet of its respective coil and the third annular flow passage outlet, the restriction producing an increase in back pressure of the refrigerant fluid in the third annular flow passage.

104. A system as claimed in claim 103, wherein the increase in back pressure produced by the said fluid flow restrictions is between 20% and 70% of the pressure in the absence of the fluid flow restriction.

105. A system as claimed in claim 104, wherein the increase in back pressure produced by the said fluid flow restrictions is between 40% and 60% of the pressure in the absence of the fluid flow restriction.

106. A system as claimed in claim 103, wherein the total flow area provided by all of the bores is not more than 1.5 times the cross-sectional flow area of the first annular flow passage.

107. A system as claimed in claim 103, wherein the cross-sectional flow area of the second annular flow passage is between 0.5 and 1.5 times the corresponding area of the first innermost flow passage.

108. A system as claimed in claim 103, wherein the cross-sectional flow area of the third outer annular flow passage is between 0.5 and 1.5 times the corresponding flow area of the refrigerant system discharge flow line from the compressor outlet.

109. A refrigeration system comprising:

a refrigerant compressor;

a plurality of parallel-connected cooling coils to be defrosted, each having an inlet and an outlet;

an expansion device for expanding and cooling refrigerant connected between the compressor and the cooling coil inlets;

a controllable defrost control valve connected to the compressor outlet to receive hot compressed refrigerant fluid therefrom;

and a liquid refrigerant vaporizer connected to the coil outlets for vaporizing liquid fluid issuing therefrom to prevent its delivery to the compressor inlet, the vaporizer comprising first, second and third chambers the interiors of which constitute respective first, second and third flow passages, the first and second passages having a first wall in common and the second and third passages having a second wall in common;

wherein the first flow passage is connected at one end into the refrigeration system so as to receive refrigerant fluid exiting from the coil outlets, is closed at the other end, and is provided in the said first common wall with a plurality of bores distributed along its length so that the refrigerant fluid flowing therein exits therefrom through the bores to impinge against the said second common wall for heat exchange therewith;

the total flow area provided by all of the said bores being at least 0.5 times the cross-sectional flow area of the first flow passage;

wherein the said second common wall is of heat conductive material, the second flow passage is closed at one end and is connected at its other end into the refrigeration system for delivery of the refrigerant fluid therefrom;

wherein the cross-sectional flow area of the said second flow passage is at least 0.5 times the cross-sectional flow area of the first flow passage; and wherein the third flow passage has an inlet thereto and an outlet therefrom to the remainder of the refrigeration system for the hot refrigerant fluid, the inlet and the outlet being spaced from one another for the hot refrigerant fluid to contact the said second common wall for heat exchange therewith;

the inlet being connected to the said controllable flow valve for the flow therethrough to be controlled by the valve, and the outlet being connected to the coil inlets for delivery of the fluid thereto; and a corresponding plurality of refrigerant fluid flow restrictions of controllable flow capacity, one for each of said plurality of coils, each connected between the inlet of its respective coil and the third annular flow passage outlet, the restrictions producing an increase in back pressure of the refrigerant fluid in the third annular flow passage.

110. A system as claimed in claim 109, wherein the increase in back pressure produced by the same fluid flow restrictions is between 20% and 70% of the pressure in the absence of the fluid flow restriction.

111. A system as claimed in claim 110, wherein the increase in back pressure produced by the said fluid flow restrictions is between 40% and 60% of the pressure in the absence of the fluid flow restriction.

112. A system as claimed in claim 109, wherein the total flow area provided by all of the bores is not more than 1.5 times the cross-sectional flow area of the first annular flow passage.

113. A system as claimed in claim 109, wherein the cross-sectional flow area of the second annular flow passage is between 0.5 and 1.5 times the corresponding area of the first innermost flow passage.

114. A system as claimed in claim 109, wherein the cross-sectional flow area of the third outermost annular flow passage is between 0.5 and 1.5 times the corresponding flow area of the refrigerant system discharge flow line from the compressor outlet.

115. A system as claimed in claim 109, wherein the said first, second and third flow passages are of rectangular configuration in plan and side elevation, and the said first and second common walls between the respective chambers are flat.

116. A system as claimed in claim 109, wherein the said first, second and third flow passages are constituted by respective concentric pipes of circular cross-section.

* * * * *